US008303354B2

(12) United States Patent
Ootsuka et al.

(10) Patent No.: US 8,303,354 B2
(45) Date of Patent: Nov. 6, 2012

(54) TERMINAL CONNECTOR AND WIRE HARNESS

(75) Inventors: Takuji Ootsuka, Yokkaichi (JP); Hiroki Hirai, Yokkaichi (JP); Junichi Ono, Yokkaichi (JP); Tetsuji Tanaka, Yokkaichi (JP); Hiroki Shimoda, Yokkaichi (JP)

(73) Assignees: Sumitomo Wiring Systems, Ltd., Mie (JP); Autonetworks Technologies, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 129 days.

(21) Appl. No.: 12/863,533

(22) PCT Filed: Feb. 12, 2009

(86) PCT No.: PCT/JP2009/052287

§ 371 (c)(1),
(2), (4) Date: Jul. 19, 2010

(87) PCT Pub. No.: WO2009/101965

PCT Pub. Date: Aug. 20, 2009

(65) Prior Publication Data

US 2010/0297894 A1 Nov. 25, 2010

(30) Foreign Application Priority Data

Feb. 15, 2008 (JP) ..... 2008-035339

(51) Int. Cl.
*H01R 4/18* (2006.01)

(52) U.S. Cl. ..... 439/877

(58) Field of Classification Search ..... 439/877, 439/880, 882; 174/84 C
See application file for complete search history.

(56) References Cited

U.S. PATENT DOCUMENTS 2,735,997 A * 2/1956 Peterson ..... 439/882
2,854,648 A * 9/1958 Berg ..... 439/867
3,990,143 A * 11/1976 Dittmann et al. ..... 29/865
4,142,771 A * 3/1979 Barnes et al. ..... 439/442
5,370,560 A * 12/1994 Ito ..... 439/877

(Continued)

FOREIGN PATENT DOCUMENTS

JP A-55-96575 7/1980

(Continued)

OTHER PUBLICATIONS

Written Opinion issued in International Patent Application No. PCT/JP2009/052287, dated Mar. 17, 2009 (with English translation).

(Continued)

*Primary Examiner* — Neil Abrams
(74) *Attorney, Agent, or Firm* — Oliff & Berridge, PLC

(57) ABSTRACT

A wire barrel to be crimped onto an end of an electric wire has a surface on a side to face the electric wire. The surface has a plurality of recesses that extend in a direction that is to cross the axial direction of the electric wire and are separated from each other in the direction that is to cross the axial direction of the electric wire. The wire barrel has a thickness in a range from 0.15 mm to 1 mm before being crimped to the electric wire. Each recess has a depth in a range from 30% to 60% of the thickness of the wire barrel before the wire barrel is crimped onto the electric wire.

16 Claims, 10 Drawing Sheets

U.S. PATENT DOCUMENTS

| | | | | |
|---|---|---|---|---|
| 5,532,433 | A * | 7/1996 | Endo et al. | 174/84 C |
| 5,658,163 | A * | 8/1997 | DeRoss | 439/424 |
| 6,056,605 | A * | 5/2000 | Nguyen et al. | 439/882 |
| 6,290,556 | B1 * | 9/2001 | Howland et al. | 439/879 |
| 6,749,457 | B2 * | 6/2004 | Sakaguchi et al. | 439/421 |
| 7,210,958 | B1 * | 5/2007 | Jacques et al. | 439/421 |
| 7,544,892 | B2 * | 6/2009 | Susai et al. | 174/84 R |
| 7,867,014 | B2 * | 1/2011 | Kuwayama | 439/452 |
| 8,052,466 | B2 * | 11/2011 | Okamoto | 439/585 |
| 8,070,536 | B2 * | 12/2011 | Ono et al. | 439/877 |
| 2010/0297894 | A1 * | 11/2010 | Ootsuka et al. | 439/877 |
| 2011/0009014 | A1 * | 1/2011 | Ono et al. | 439/877 |
| 2011/0124247 | A1 * | 5/2011 | Okamura et al. | 439/877 |
| 2012/0028494 | A1 * | 2/2012 | Ono et al. | 439/442 |

FOREIGN PATENT DOCUMENTS

| | | |
|---|---|---|
| JP | A-55-108192 | 8/1980 |
| JP | U-62-86069 | 6/1987 |
| JP | A-10-125362 | 5/1998 |

OTHER PUBLICATIONS

International Search Report issued in International Patent Application No. PCT/JP2009/052287, dated Mar. 17, 2009.

Jul. 2, 2012 Office Action issued in Chinese Patent Applicaion No. 200980104781.6 (with translation).

* cited by examiner

TERMINAL CONNECTOR AND WIRE HARNESS

TECHNICAL FIELD

The present invention relates to a terminal connector and a wire harness.

BACKGROUND ART

A terminal connector to be connected to an end of an electric wire disclosed in Patent Document 1 is known as an example of such a kind. This terminal connector includes a crimping portion that is constructed from a metal plate and to be crimped onto a bare portion of a core wire located at an end of the electric wire.

When an oxide layer is formed on the core wire, a contact resistance between the core wire and the crimping portion may increase due to the oxide layer between the core wire and the crimping portion.

In the known art, recesses (serrations) are formed on the inner surface of the crimping portion so as to continuously extend in a direction that crosses the axis of the electric wire. A plurality of the recesses are formed next to each other in the axial direction of the electric wire.

When the crimping portion is crimped onto the core wire of the electric wire, the crimping portion is pressed against the core wire and the core wire stretches in the axial direction thereof. The oxide layer on the surface of the core wire is removed as the core wire rubs against opening edges of the recesses. As a result, the surface of the core wire emerges and comes in contact with the crimping portion. Therefore, the contact resistance between the electric wire and the terminal connector decreases.

Patent Document 1: Japanese Patent Application Publication No. 10-125362

DISCLOSURE OF THE INVENTION

Recently, the use of aluminum or aluminum alloy as a material of the core wire is considered. An oxide layer tends to be formed on an aluminum or aluminum alloy surface. Therefore, if aluminum or aluminum alloy is used for the core wire of the electric wire, the contact resistance between the core wire and the crimping portion may not sufficiently decrease even when the recesses are provided.

Therefore, reducing a compression rate of the crimping portion is considered. The compression rate is defined by [(an area of a compressed conductor)/(an area of a pre-compressed conductor)]*100. To reduce the compression rate, the area of the compressed conductor needs to be reduced. Namely, the crimping portion needs to be crimped onto the core wire with a large force so that the oxide layer formed on the core wire is sufficiently removed and the contact resistance between the core wire and the crimping portion decreases as the rims of the openings of the recessed are pressed against the core wire.

However, a large plastic deformation of the crimping portion occurs in the axial direction when the compression rate of the crimping portion is reduced. As a result, a physical strength of the crimping portion around the recesses where the thickness thereof is relatively small may decrease.

Therefore, there is a need in the art to provide a terminal connector and a wire harness including this terminal connector, a contact resistance with an electric wire of which is improved while a mechanical strength thereof is maintained.

SUMMARY

The present invention relates to a terminal connector including a cramping portion that is constructed from a metal plate and to be crimped onto an end of an electric wire. The crimping portion has a surface on a side to face the electric wire. The surface has a plurality of recesses extending in a direction that is to cross an axial direction of the electric wire and separated from each other in the direction that is to cross the axial direction of the electric wire. The crimping portion has a thickness in a range from 0.15 mm to 1 mm before being crimped onto the electric wire. Each of the recesses has a depth in a rage from 30% to 60% of the thickness of the crimping portion before the crimping portion is crimped onto the electric wire.

The present invention also relates to a wire harness including an electric wire including a conductor and a terminal connector connected to a bare portion of the conductor. The terminal connector has a surface facing the electric wire and having a plurality of recesses extending in a direction that crosses an axial direction of the electric wire and separated from each other in the direction that crosses the axial direction of the electric wire. The crimping portion has a thickness in a range from 0.15 mm to 1 mm before being crimped onto the electric wire. Each of the recesses has a depth in a rage from 30% to 60% of the thickness of the crimping portion before the crimping portion is crimped onto the electric wire.

When the crimping portion is crimped onto the electric wire, it is pressed against the electric wire. As a result, the electric wire stretches in the axial direction thereof and rims of openings of the recesses that extend in the direction that crosses the axial direction of the electric wire rub against the electric wire. An oxide layer formed on the surface of the electric wire is removed and the surface of the electric wire emerges. The emerged surface of the electric wire comes in contact with the crimping portion and thus a contact resistance between the electric wire and the terminal connector decreases.

When the crimping portion is crimped onto the electric wire, the crimping portion is plastically deformed in the axial direction of the electric wire. In the present invention, the recesses are provided so as to be separated from each other in the direction that crosses the axial direction of the electric wire. Therefore, areas without the recesses remain between the adjacent recesses. The areas absorb a force to plastically deform the crimping portion in the axial direction of the electric wire. Therefore, the recesses do not significantly expand in the axial direction of the electric wire and thus the physical strength of the terminal connector can be maintained.

According to the present invention, as described above, the areas absorb the force to plastically deform the crimping portion in the axial direction of the electric wire. Therefore, each recess can have a larger depth in comparison to a recess that is formed continuously in the direction that crosses the axial direction of the electric wire. Specifically, when the thickness of the crimping portion is in a range from 0.15 mm to 1 mm, each recess can have a depth in a range from 30% to 60% of the thickness of the crimping portion. By setting the depth of each recess in the range equal to or higher than 30%, the rims of the openings of the recesses can be adequately pressed against the electric wire when the crimping portion is crimped onto the electric wire. As a result, the contact resistance between the electric wire and the terminal connector further decreases. By setting the depth of each recess in the range equal to or lower than 60%, the strength of the terminal connector can be maintained. If the thickness of the crimping portion is smaller than 0.15 mm, the sufficient strength of the terminal connector cannot be achieved.

According to the present invention, the contact resistance between the electric wire and the terminal connector can be reduced while the physical strength of the terminal connector is maintained.

EXPLANATION OF REFERENCE CHARACTERS

Figure 1:
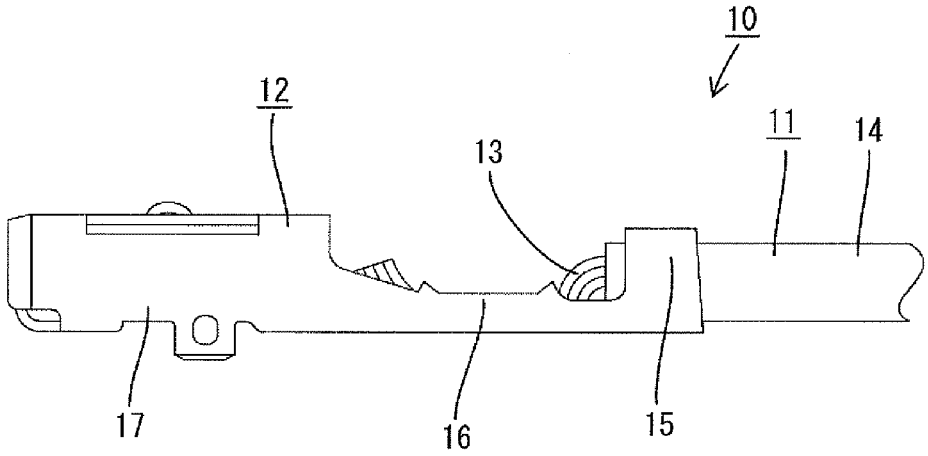
FIG. 1 is a magnified view illustrating a relevant part of a wire harness according to the first embodiment.

10: Wire harness
11: Electric wire
12: Female terminal connector (terminal connector)
13: Core wire
14: Wire insulation
16: Wire barrel (crimping portion)
17: Connecting portion
18: Recess

BEST MODE FOR CARRYING OUT THE INVENTION

First Embodiment

The first embodiment of the present invention will be explained with reference to FIGS. 1 to 5. A wire harness 10 of this embodiment includes an electric wire 11 and a female terminal connector 12 (corresponding to a terminal connector) connected to an end of the electric wire 11.

As illustrated in FIG. 1, the electric wire 11 includes a core wire (corresponding to a conductor) 13 that is covered with wire insulation 14. The core wire 13 is made of aluminum, aluminum alloy, copper, copper alloy or any other kind of metal suitable for intended application. The core wire 13 may be a cord constructed of a plurality of thin wires are laid or a single wire.

As illustrated in FIG. 1, the female terminal connector 12 is prepared by pressing a metal plate (not shown) into a predefined shape. The female terminal connector 12 includes an insulation barrel 15 that is crimped onto the electric wire 11 so as to surround the wire insulation 14. On the left side of the insulation barrel 15 in FIG. 1, a wire barrel 16 (corresponding to the crimping portion) is provided so as to continue from the insulation barrel 15. The wire barrel 16 is crimped onto the electric wire 11 so as to surround the core wire 13.

On the left side of the wire barrel 16 in FIG. 1, a connecting portion 17 having a tubular shape is provided. The connecting portion 17 is to be fitted to a male terminal connector (corresponding to another terminal connector) and electrically connected. The male terminal connector is not shown in the figures.

Figure 2:
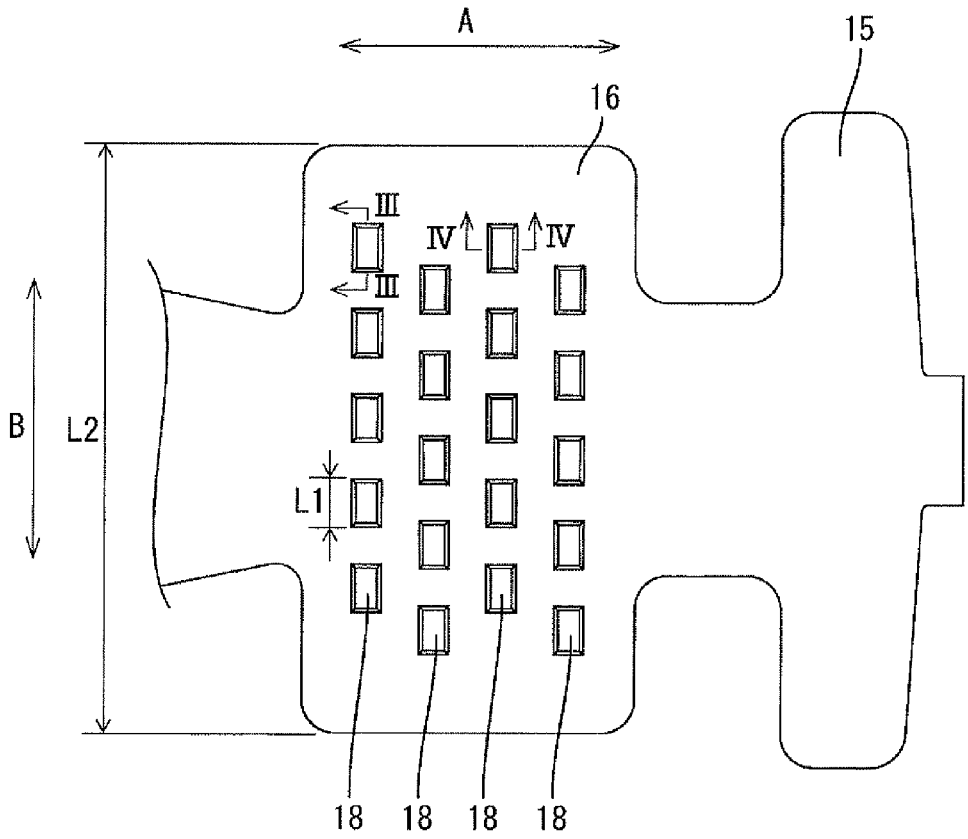
FIG. 2 is a magnified plan view illustrating a relevant part of a wire barrel before being crimped onto an electric wire.

FIG. 2 illustrates the wire barrel 16 before being crimping onto the electric wire 11. A surface of the wire barrel 16 illustrated in FIG. 2 is located inside, that is, on the electric wire 11 side when the wire barrel 16 is crimped onto the electric wire 11. A plurality of recesses 18 are formed in the surface of the wire barrel 16 illustrated in FIG. 2 and hollowed toward the surface on the other side.

Each recess 18 extends in the direction (indicated by arrow B in FIG. 2) that crosses the axial direction of the electric wire 11 (indicated by arrow A in FIG. 2) and forms an elongated substantially rectangular shape. A plurality of the recesses 18 (five of them in this embodiment) are provided at regular intervals on a line that crosses the axial direction of the electric wire 11.

Furthermore, the recesses 18 are provided on a plurality of lines (four lines in this embodiment). The lines of the recesses 18 are formed at regular intervals in the axial direction of the electric wire 11. The recesses 18 located adjacent to each other in the axial direction of the electric wire 11 are shifted from each other in the axial direction. Namely, the recesses 18 are provided in a staggered layout as a whole.

Figure 3:
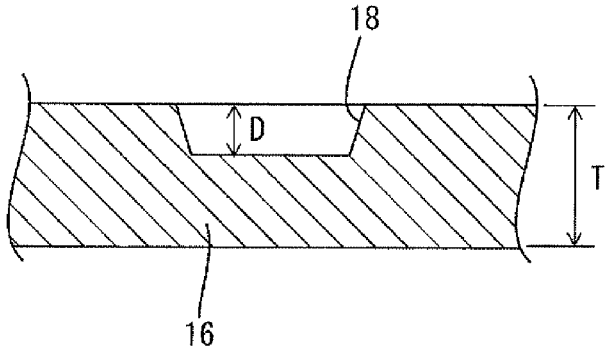
FIG. 3 is a cross-sectional view of the wire barrel in FIG. 2 along line
Figure 4:
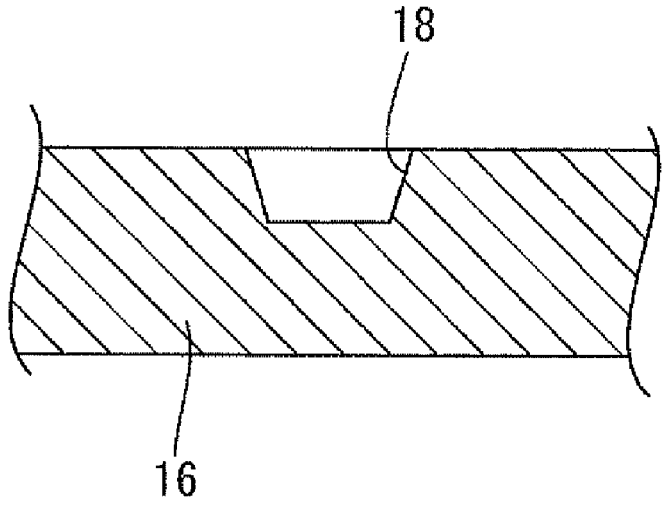
FIG. 4 is a cross-sectional view of the wire barrel in FIG. 2 along line IV-IV.

As illustrated in FIGS. 3 and 4, each recess 18 looks substantially trapezoid in the cross-sectional view of the wire barrel 16. The width of the bottom of each recess 18 is the smallest and gradually increases toward a rim of the opening. An edge is formed at the rim of the opening of the recess 18.

Figure 5:
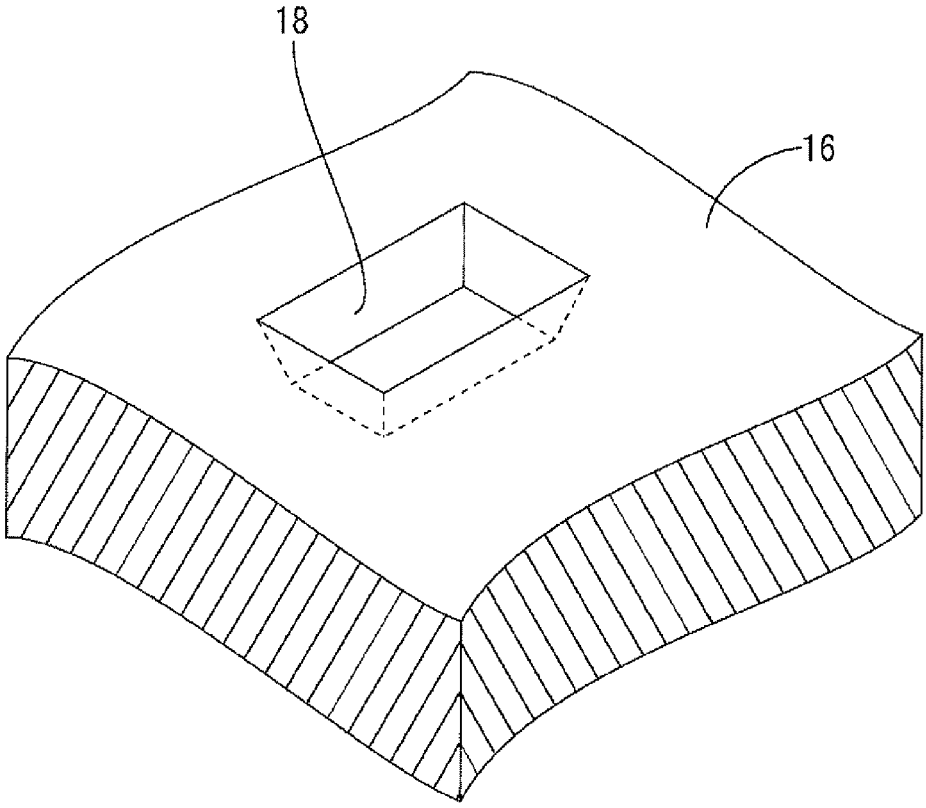
FIG. 5 is a magnified perspective view illustrating a relevant part around a recess.

As illustrated in FIG. 5, the bottom area of each recess 18 is larger than the opening area thereof.

As illustrated in FIG. 3, if the thickness T of the wire barrel 16 before being crimped onto the electric wire 11 is in a range from 0.15 mm to 1 mm, the depth D of each recess 18 before the wire barrel is crimped onto the electric wire 11 is in a range from 30% to 60% of the thickness T of the wire barrel 16.

In the condition that the wire barrel 16 is crimped onto the electric wire 11, a sum of lengths L1 of the recesses 18 in the direction that the recesses 18 extend is in a range from 5% to 50% of the length L2 of the wire barrel 16 in the direction that the recesses 18 extend.

Next, functions and effects of this embodiment will be explained. The following is an example of a mounting process of the female terminal connector 12 to the electric wire 11. First, a metal plate is pressed into a predefined shape. The recesses 18 can be also formed in this step.

Then, the metal plate pressed in the predefined shape is bent to form the connecting portion 17. The recesses 18 may be formed in this step.

Next, the wire insulation 14 of the electric wire 11 is removed so that the core wire 13 is uncovered. The core wire 13 is placed on the wire barrel 16 and a part of the electric wire 11 covered with the wire insulation 14 is placed on the insulation barrel 15. Then both barrels are crimped onto the electric wire 11 by a crimping tool (not shown).

When the wire barrel 16 is crimped onto the core wire 13, the core wire 13 is pressed by the wire barrel 16 and extends in the axial direction thereof as it is plastically deformed. The core wire 13 rubs against the rims of the openings of the recesses 18 that extend in the direction crossing the axial direction of the electric wire 11. As a result the oxide layer is removed from the surface of the core wire 13 and the surface of the core wire 13 emerges. Therefore, the surface of the core wire 13 comes in contact with the wire barrel 16 and thus the contact resistance between the electric wire 11 and the female terminal connector 12 decreases.

When the wire barrel 16 is crimped onto the electric wire 11, the wire barrel 16 is also elastically deformed and extends in the axial direction of the electric wire 11. As a result, the recesses 18 formed in the wire barrel 16 expand and thus the physical strength of the wire barrel 16 around the recesses 18 may decrease.

In this embodiment, the recesses 18 are spaced from each other in the direction that crosses the axial direction of the electric wire 11. Namely, areas without the recesses 18 exist between the adjacent recesses 18. The areas without the recesses 18 absorb forces to plastically deform the wire barrel 16 in the axial direction of the electric wire 11. Therefore, the recesses 18 do not significantly expand in the axial direction of the electric wire 11 and thus the physical strength of the female terminal connector 12 can be maintained.

According to this embodiment, the forces to plastically deform the wire barrel 16 in the axial direction of the electric wire 11 are absorbed by the areas without the recesses 18, as described above. In comparison to a wire barrel having the recesses 18 formed continuously in the direction that crosses the axial direction of the electric wire 11, the recesses 18 can have a larger depth. Specifically, if the thickness of the wire barrel 16 is in the range from 0.15 mm to 1 mm, the recesses 18 can have a depth in the range from 30% to 60% of the thickness of the crimping portion. By setting the depth 30% or higher of the thickness, the rims of the openings of the recesses 18 are sufficiently pressed against the core wire 13 when the wire barrel 16 is crimped onto the electric wire 11. As a result, the contact resistance between the electric wire 11 and the female terminal connector 12 further decreases. By setting the depth 60% or lower of the thickness, the strength of the terminal connector can be maintained. If the thickness of the wire barrel 16 is smaller than 0.15 mm, the strength of the female connector 12 cannot be maintained.

In this embodiment, in the condition that the wire barrel 16 is not yet crimped onto the electric wire 11, the sum of lengths L1 of the recesses 18 on one line in the direction in which the recesses 18 are to expand (in the direction indicated by arrow B in FIG. 2) is defined in the range from 5% to 50% of the length L2 of the wire barrel 16 in the direction in which the recesses 18 are to expand. By setting the sum of lengths L1 of the recesses 18 on one line in the direction in which the recesses 18 are to expand equal to or higher than 5% of the length L2 of the wire barrel 16, the oxide layer can be removed from the core wire 13 by the rims of the openings of the recesses 18. Therefore, the contact resistance between the electric wire 11 and the female terminal connector 12 can be reduced. Furthermore, by setting the sum of lengths L1 of the recesses 18 on one line in the direction in which the recesses 18 are to expand equal to or lower than 50% of the length L2 of the wire barrel 16, the physical strength of the terminal connector can be maintained when the wire barrel 16 is crimped onto the core wire 13.

The sum of the lengths L1 of the recesses 18 in the direction in which the recesses 18 expand should be in the range from 10% to 30% of the length L2 of the wire barrel. When the sum is equal to or higher than 10% of the length L2, more reliable removal of the oxide layer formed on the surface of the core wire 13 can be provided and thus the sum should be equal to or higher than 10% of the length L2. When the sum is equal to or lower than 30% of the length L2, the physical strength of the terminal connector can be maintained at an adequate level and thus the sum should be equal to or lower than 30% of the length L2.

In this embodiment, the recesses 18 are formed on lines that are spaced from each other in the axial direction of the electric wire 11. With this configuration, a larger contact area can be achieved between the core wire 13 and the rims of the openings of the recesses 18 of the female terminal connector 12 in comparison to a wire barrel having the recesses 18 formed continuously on a line. As a result, the contact resistance between the electric wire 11 and the female terminal connector further decreases.

In the areas without the recesses 18, the core wire 13 does not come in contact with the rims of the openings of the recesses 18. Therefore, the contact resistance between the electric wire 11 and the female terminal connector 12 may be different from area to area.

In this embodiment, therefore, the recesses 18 that are adjacent to each other in the axial direction of the electric wire 11 are shifted from each other in the axial direction. In this structure, the recesses 18 are dispersed and thus the core wire 13 evenly rub against the rims of the openings of the recesses 18 in the axial direction of the electric wire 11. Therefore, contact resistance between the electric wire 11 and the female terminal connector 12 does not change from area to area.

If the core wire 13 is made of aluminum or aluminum alloy, the wire barrel 16 needs to be crimped onto the core wire 13 with a low compression rate (e.g., about 40% to 70%) to reduce the contact resistance by removing the oxide layer formed on the surface of the core wire 13. In such a case, this embodiment is highly effective. The compression rate is defined by [(an area of a compressed conductor)/an area of a pre-compressed conductor]]*100.

Second Embodiment

Figure 6:
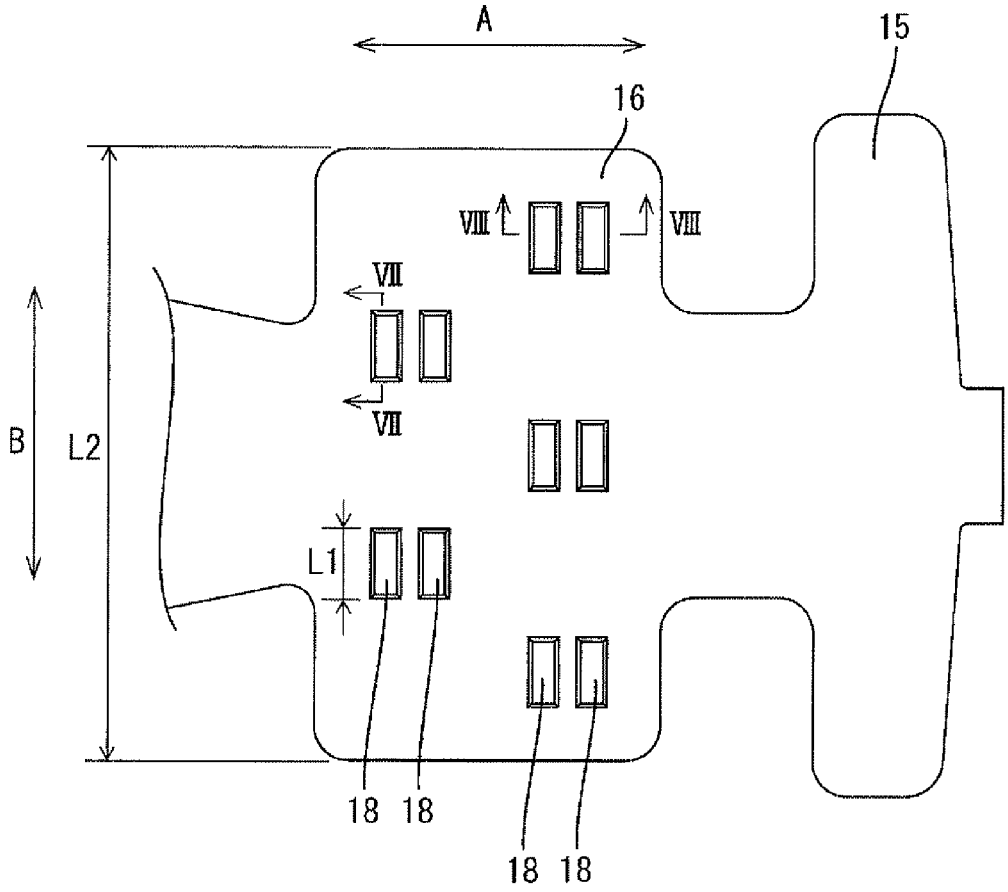
FIG. 6 is a magnified plan view illustrating a relevant part of a wire barrel of a female terminal connector according to the second embodiment.

The second embodiment will be explained with reference to FIGS. 6 to 9. As illustrated in FIG. 6, recesses include pairs of the recesses 18 spaced from each other in the axial direction of the electric wire 11 (indicated by arrow A).

Each pair of the recesses 18 is formed on lines (two lines in this embodiment) that are spaced from each other in the axial direction of the electric wire 11. The pairs of the recesses 18 adjacent to each other in the axial direction of the electric wire 11 are shifted from each other in the axial direction of the electric wire 11.

Figure 7:
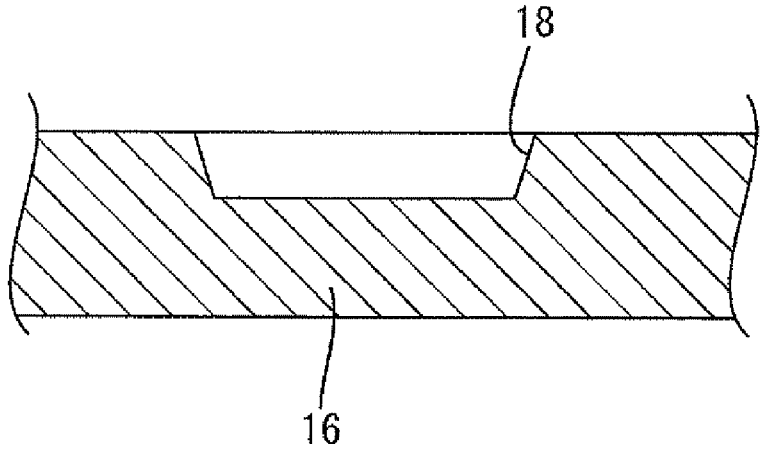
FIG. 7 is a cross-sectional view of the wire barrel in FIG. 6 along line VII-VII.
Figure 8:
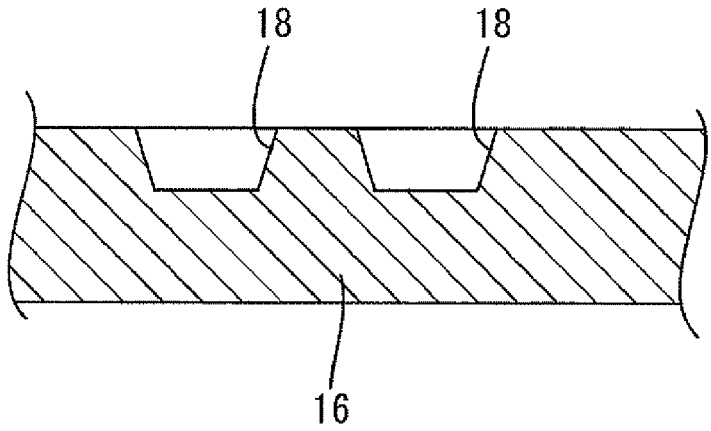
FIG. 8 is a cross-sectional view of the wire barrel in FIG. 6 along line VIII-VIII.

As illustrated in FIG. 6, each recess 18 has an elongated substantially rectangular shape that extends in a direction that crosses the axial direction of the electric wire 11 (indicated by arrow B). As illustrated in FIGS. 7 and 8, each recess 18 looks substantially trapezoid in the cross-sectional view of the wire barrel 16. The width of the bottom of each recess 18 is the smallest and gradually increases toward a rim of the opening. An edge is formed at the rim of the opening of the recess 18.

Figure 9:
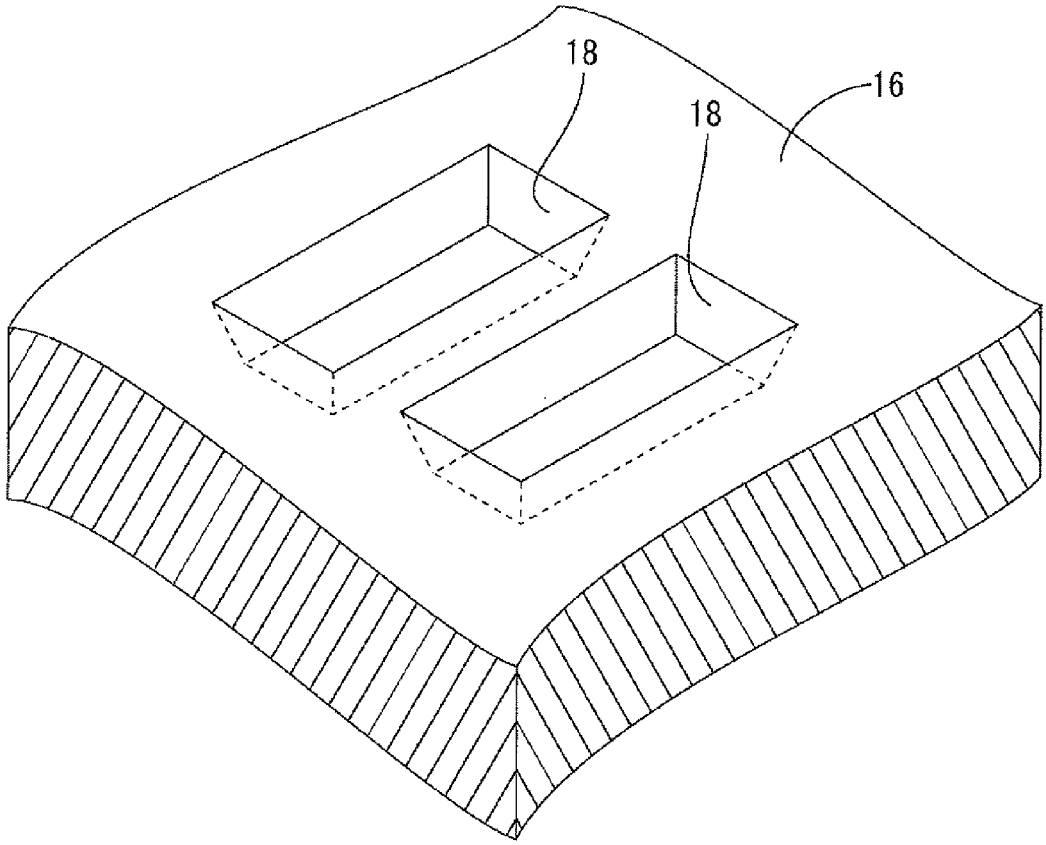
FIG. 9 is a magnified perspective view illustrating a relevant part around a recess.

As illustrated in FIG. 9, the recesses 18 in a pair are relatively close to each other.

Other structural features are mostly the same as those of the first embodiment. The same parts are indicated by the same symbols and will not be explained.

Next, the functions and effects of this embodiment will be explained. In this embodiment, the recesses 18 are provided in pairs that are spaced from each other in the axial direction of the electric wire 11. The recesses 18 in a pair are located relatively close to each other (see FIG. 9). In an area between the recesses 18, a relatively large stress is applied to the core wire 13. Therefore, parts of the rims located between the recesses 18 in the pair are pressed against the core wire 13 and thus the contact resistance between the electric wire 11 and the female terminal connector 12 further decreases.

In this embodiment, the pairs of the recesses 18 are provided on lines that are separated from each other in the axial direction of the electric wire 11. With this structure, a larger contact area can be achieved between the core wire 13 and the rims of the openings of the recesses 18 of the female terminal connector 12 in comparison to a wire barrel having the recesses 18 formed continuously on a line. As a result, the contact resistance between the electric wire 11 and the female terminal connector 12 further decreases.

In the areas between the recesses 18 adjacently located in the direction that crosses the axial direction of the electric wire 11, the rims of the openings of the recesses 18 do not rub against the core wire 13. Therefore, the contact resistance between the electric wire 11 and the female terminal connector 12 may be different from area to area.

In this embodiment, therefore, the pairs of the recesses 18 that are adjacent to each other in the axial direction of the electric wire 11 are shifted from each other in the axial direction. In this configuration, the recesses 18 are dispersed and thus the rims of the openings of the recesses 18 evenly rub against the core wire 13 in the axial direction of the electric wire 11. Therefore, contact resistance between the electric wire 11 and the female terminal connector 12 does not change from area to area.

Other Embodiments

The present invention is not limited to the above embodiments explained in the above description. The following embodiments may be included in the technical scope of the present invention, for example.

(1) In the above embodiments, the recesses 18 are provided at regular intervals in the direction that crosses the axial direction of the electric wire 11. However, the recesses 18 may be provided at uneven intervals according to the distribution of stress in the wire barrel 16.

(2) In the above embodiments, the recesses 18 are provided on lines that are spaced from each other in the axial direction of the electric wire 11 at regular intervals. However, the lines of the recesses 18 are not necessary to be at equal intervals. They may be at different intervals according to the distribution of stress in the wire barrel 16.

(3) In the above embodiment, the recesses 18 adjacent to each other in the axial direction of the electric wire 11 are shifted from each other in the axial direction of the electric wire 11. However, the recesses 18 can be lined up in the direction that crosses the axial direction of the electric wire 11.

(4) The recesses 18 can have the same depth or different depths depending on locations in which they are formed.

(5) In the above embodiments, the female terminal connector 12 is used as a terminal connector. However, a male terminal connector or a ring type terminal connector having a hollow disc shape (also referred to as an LA terminal) may be used. Namely, the connecting portion 17 of the terminal connector can have any shape suitable for intended application.

(6) In the above embodiments, the electric wire 11 is a covered wire. However, it can be a bare wire as long as it is insulated. Moreover, it may be a shielded wire. Any kind of wire suitable for intended application can be used.

(7) The barrel portion of the insulation barrel 15 can be formed in a shape having three or more pieces extend alternatively on right and left sides, or only one piece.

(8) In the first embodiments, the recesses 18 are provided on four lines that are spaced from each other in the axial direction of the electric wire 11. However, they may be provided on one, two or three lines, or on five lines.

Figure 10:
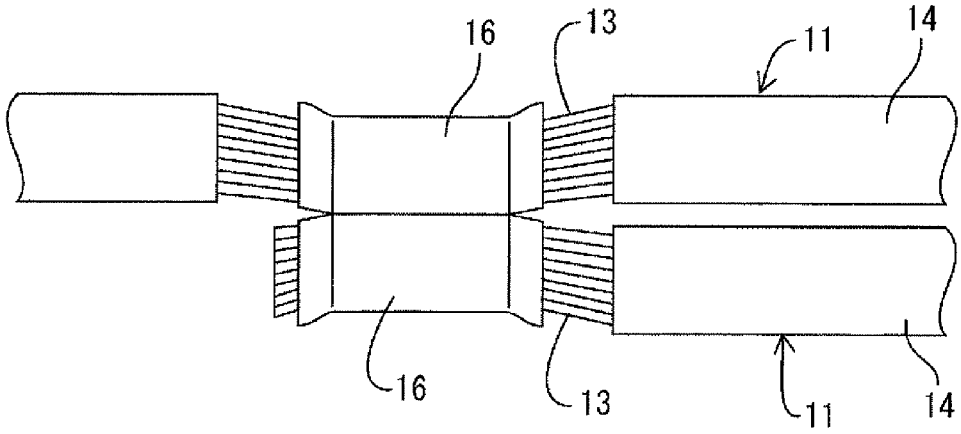
FIG. 10 is a plan view illustrating a terminal connector having an intermediate splicing structure according to another embodiment.

(9) In the above embodiments, the terminal connector includes the wire barrel 16 and the connecting portion 17 that are adjacent to each other. However, the terminal connector without the connecting portion 17 can be used. For example, the terminal connector may have an intermediate splicing structure in which the core wires 13 of two different wires 11 are connected as illustrate in FIG. 10. A part of the wire insulation 14 located at the end of one of the electric wires 11 is removed so that the core wire 13 therein emerges. A part of the wire insulation 14 located at the middle portion of the other one of the electric wires 11 is removed so that the core wire 13 therein emerges. Then, the wire barrels 16 provided in a pair are crimped onto the respective core wires 13. Another intermediate splicing structure can be applied. Both core wires 13 of two different electric wires 11 may be exposed at the middle portions of the electric wires 11, respectively. Then, the wire barrels provided in a pair are crimped onto the bare portions of the respective core wires 13.

The invention claimed is:

1. A terminal connector comprising:

a crimping portion constructed from a metal plate and to be crimped onto an end of an electric wire, wherein:

the crimping portion has a surface on a side to face the electric wire, the surface having a plurality of recesses extending in a direction that is to cross an axial direction of the electric wire and separated from each other in the direction that is to cross the axial direction of the electric wire;

the recesses are each formed in a rectangular shape;

the crimping portion has a thickness in a range from 0.15 mm to 1 mm before being crimped onto the electric wire;

each of the recesses has a depth in a rage from 30% to 60% of the thickness of the crimping portion before the crimping portion is crimped onto the electric wire; and the recesses adjacent to each other in a direction corresponding to the axial direction of the electric wire are shifted from each other in the direction that is to cross the direction corresponding to the axial direction of the electric wire.

2. The terminal connector according to claim 1, wherein in a state before the crimping portion is crimped onto the electric wire, a sum of lengths of the recesses in the direction in which the recesses extend is in a range from 5% to 50% of a length of the crimping portion measuring in the direction in which the recesses extend.

3. The terminal connector according to claim 2, wherein the recesses are provided on a plurality of lines that are separated from each other in the axial direction of the electric wire.

4. The terminal connector according to claim 3, wherein the recesses are provided in pairs that are separated from each other in the direction corresponding to the axial direction of the electric wire.

5. The terminal connector according to claim 1, wherein the recesses are provided on a plurality of lines that are separated from each other in the axial direction of the electric wire.

6. The terminal connector according to claim 1, wherein the recesses are provided in pairs that are separated from each other in a direction corresponding to the axial direction of the electric wire.

7. The terminal connector according to claim 1, wherein a connecting portion that is connected to another terminal connector is provided adjacent to the crimping portion.

8. A wire harness comprising:

an electric wire including a conductor; and a terminal connector connected to a bare portion of the conductor, wherein:

the terminal connector has a surface facing the electric wire and having a plurality of recesses extending in a direction that crosses an axial direction of the electric wire and separated from each other in the direction that crosses the axial direction of the electric wire;

the recesses are each formed in a rectangular shape;

the crimping portion has a thickness in a range from 0.15 mm to 1 mm before being crimped onto the electric wire; and each of the recesses has a depth in a rage from 30% to 60% of the thickness of the crimping portion before the crimping portion is crimped onto the electric wire; and the recesses adjacent to each other in a direction corresponding to the axial direction of the electric wire are shifted from each other in the direction that is to cross the direction corresponding to the axial direction of the electric wire.

9. The wire harness according to claim 8, wherein in a state before the crimping portion is crimped onto the electric wire, a sum of lengths of the recesses in the direction in which the recesses extend is in a range from 5% to 50% of a length of the crimping portion measuring in the direction in which the recesses extend.

10. The wire harness according to claim 9, wherein the recesses are provided on a plurality of lines that are separated from each other in the axial direction of the electric wire.

11. The wire harness according to claim 10, wherein the recesses are provided in pairs that are separated from each other in the axial direction of the electric wire.

12. The wire harness according to claim 11, wherein the conductor is made of any one of aluminum and aluminum alloy.

13. The wire harness according to claim 8, wherein the recesses are provided on a plurality of lines that are separated from each other in the axial direction of the electric wire.

14. The wire harness according to claim 8, wherein the recesses are provided in pairs that are separated from each other in the axial direction of the electric wire.

15. The wire harness according to claim 8, wherein the conductor is made of any one of aluminum and aluminum alloy.

16. The wire harness according to claim 8, wherein the terminal connector includes a connecting portion adjacent to the crimping portion, wherein the connecting portion is connected to another terminal connector.

* * * * *